US005088509A

United States Patent [19]

Savage, III

[11] Patent Number: 5,088,509

[45] Date of Patent: Feb. 18, 1992

[54] MANICURE FILE KIT

[76] Inventor: Arthur H. Savage, III, 6722 N.W. Pennsylvania, Kansas City, Mo. 64118

[21] Appl. No.: 636,205

[22] Filed: Dec. 31, 1990

[51] Int. Cl.[5] ..... A45D 29/18

[52] U.S. Cl. ..... 132/76.5; 132/73.5; 132/76.2; 132/76.4

[58] Field of Search ..... 132/73, 73.5, 75.4, 132/75.6, 75.2, 76.4, 76.5, 286; 433/142, 166

[56] References Cited

U.S. PATENT DOCUMENTS

| | | | |
|---|---|---|---|
| 1,616,355 | 2/1927 | Considine | 132/76.4 |
| 1,652,771 | 12/1927 | Deubel | 132/75.4 |
| 1,897,754 | 2/1933 | Farris | 132/76.5 |
| 2,279,533 | 4/1942 | Shore | 132/75.6 |
| 4,683,898 | 8/1987 | Lojovich | 132/76.4 |
| 4,930,529 | 6/1990 | Whitney | 132/76.5 |

FOREIGN PATENT DOCUMENTS

| | | | |
|---|---|---|---|
| 0202139 | 11/1986 | European Pat. Off. | 132/7.3 |
| 141337 | 9/1920 | United Kingdom | 132/73 |

*Primary Examiner*—John J. Wilson
*Assistant Examiner*—Frank A. LaViola
*Attorney, Agent, or Firm*—Leon Gilden

[57] ABSTRACT

An organization wherein a file member includes a generally "S" shaped body formed with a central holding plate and a first and second planar body member each arranged parallel relative to one another, with the first body plate including a first movable sheath, with a pusher blunt end. The second body member defines a file with a series of selectively positionable sheath members, including abrading surfaces of various degrees of courseness. Further, a sheath with a brush is provided. The first planar body further includes a plurality of "V" shaped cutter members arranged for trimming cuticle portions during use.

1 Claim, 3 Drawing Sheets

MANICURE FILE KIT

BACKGROUND OF THE INVENTION

1. Field of the Invention

The field of invention relates to manicure apparatus, and more particularly pertains to a new and improved manicure file kit wherein the same provides selectively operative accessories for use in a manicure procedure.

2. Description of the Prior Art

Various file organizations have been set forth in the prior art to effect a manicure procedure. Such examples of the prior art may be found in U.S. Pat. No. 4,683,898 to Lojovich wherein a manicure file defines an "S" shaped body of generally triangular blades arranged relative to one another, including an abrading medium mounted thereon.

U.S. Pat. No. 3,298,381 to Adams sets forth a manicure implement defined by blades of various degrees of curvature for coveting various portions of associated cuticles during a manicure procedure.

U.S. Design Pat. Nos. 284,045; 294,303; and 249,167 set forth further examples of file configurations.

As such, it may be appreciated that there continues to be a need for a new and improved manicure file kit which addresses both the problems of ease of use as well as effectiveness in construction and in this respect, the present invention substantially fulfills this need.

SUMMARY OF THE INVENTION

In view of the foregoing disadvantages inherent in the known types of manicure apparatus now present in the prior art, the present invention provides a manicure file kit wherein the same provides an organization to accommodate various manicuring considerations. As such, the general purpose of the present invention, which will be described subsequently in greater detail, is to provide a new and improved manicure file kit which has all the advantages of the prior art manicure apparatus and none of the disadvantages.

To attain this, the present invention provides an organization wherein a file member includes a generally "S" shaped body formed with a central holding plate and a first and second planar body member each arranged parallel relative to one another, with the first body plate including a first removable sheath, with a pusher blunt end. The second body member defines a file with a series of selectively positionable sheath members, including abrading surfaces of various degrees of courseness. Further, a sheath with a brush is provided. The first planar body further includes a plurality of "V" shaped cutter members arranged for trimming cuticle portions during use.

My invention resides not in any one of these features per se. but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon Which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved manicure file kit which has all the advantages of the prior art manicure apparatus and none of the disadvantages.

It is another object of the present invention to provide a new and improved manicure file kit which may be easily and efficiently manufactured and marketed.

It is a further object of the present invention to provide a new and improved manicure file kit which is of a durable and reliable construction.

An even further object of the present invention is to provide a new and improved manicure file kit which is susceptible of a low cost of manufacture with regard to both materials and labor, and which accordingly is then susceptible of low prices of sale to the consuming public, thereby making such manicure file kits economically available to the buying public.

Still yet another object of the present invention is to provide a new and improved manicure file kit which provides in the apparatuses and methods of the prior art some of the advantages thereof, while simultaneously overcoming some of the disadvantages normally associated therewith.

Still another object of the present invention is to provide a new and improved manicure file kit wherein the same provides an organization mounted for convenience of use and access to various of the accessories to accommodate various manicuring situations.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
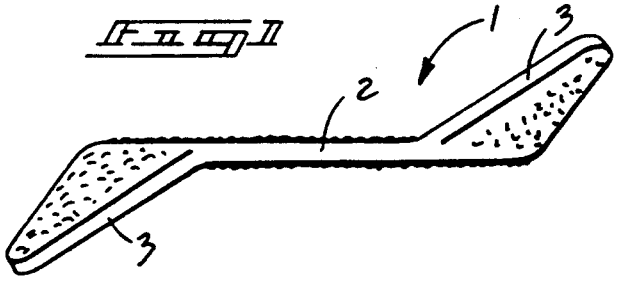
FIG. 1 is an isometric illustration of a prior art manicure file.
Figure 2:
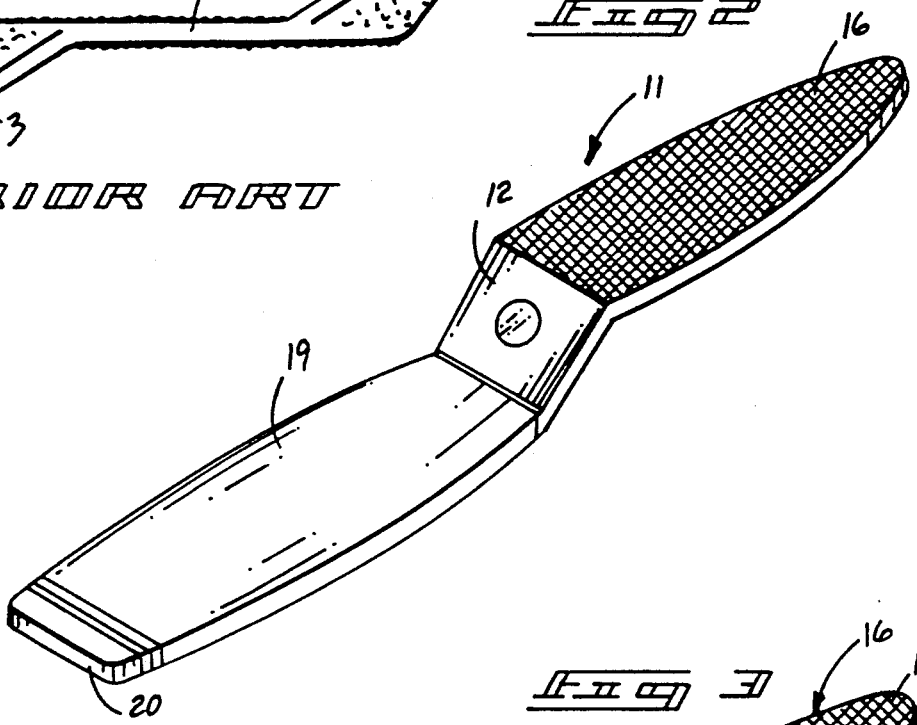
PRIOR ART Fig 2
FIG. 2 is an isometric illustration of the manicure file and sheath utilized by the instant invention.
Figure 3:
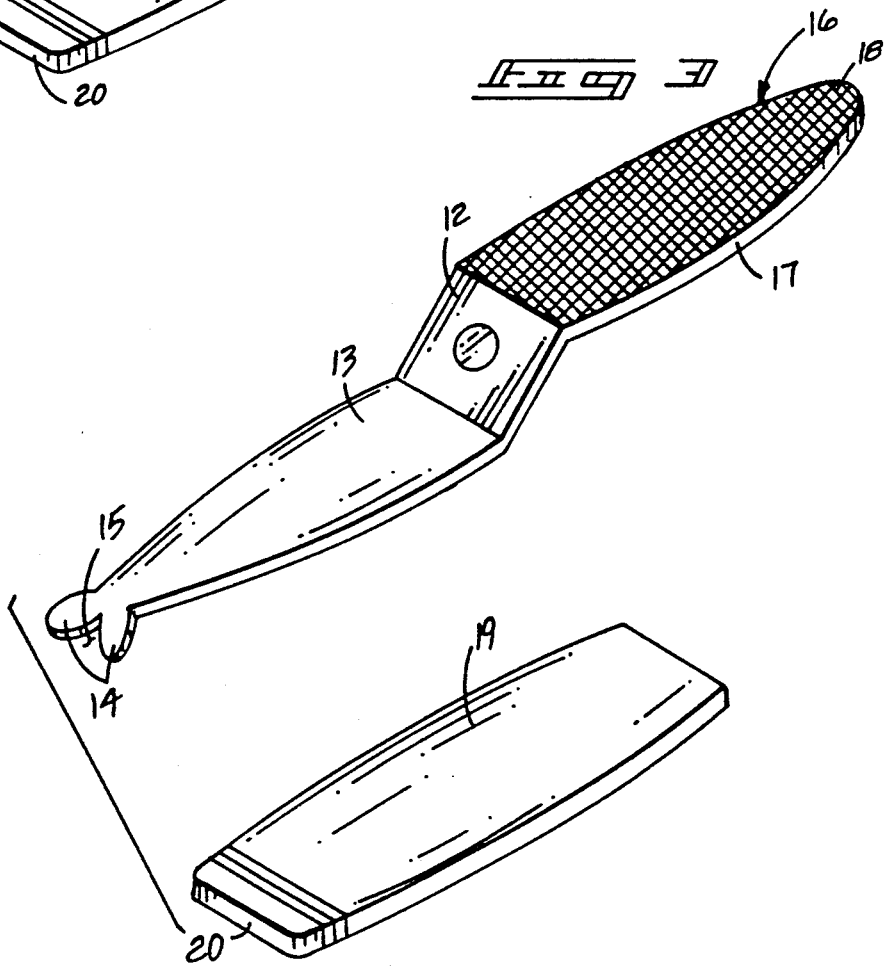
FIG. 3 is an isometric illustration of the manicure file and the sheath in a separated configuration.
Figure 4:
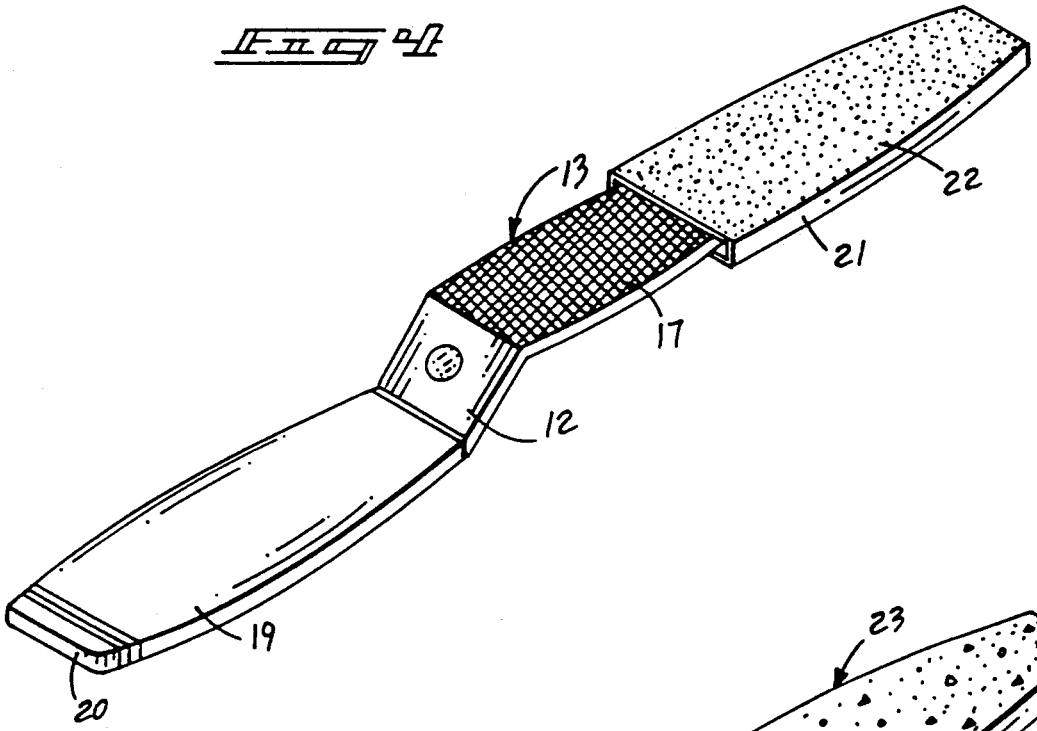
FIG. 4 is an isometric illustration of the file utilized by the instant invention and a second sheath.

With reference now to the drawings, and in particular to FIGS. 1 to 8 thereof, a new and improved manicure file kit embodying the principles and concepts of the present invention and generally designated by the reference numeral 10 will be described.

FIG. 1 illustrates a prior art file 1 of an "S" shaped configuration, with a central body 2, and spaced triangular blades 3 defining an abrading surface mounted about the planar surfaces of the blades in use, in a manner as set forth in U.S. Pat. No. 4,683,898.

More specifically, the manicure file kit 10 of the instant invention essentially comprises a file body 11 defined by an "S" shaped configuration, including a central holding plate 12 and a first elongate planar blade body 13 spaced from and parallel to an elongate planar blade body 16. The blade bodies are generally of an elongate longitudinally aligned configuration, with the first elongate planar blade body 13 including a plurality of spaced blades 14 mounted at a forward terminal end of the first planar blade body defining an acute angle therebetween of a "V" shaped gap 15 to permit reception of a cuticle therebetween for a trimming procedure by the cutting blades 14. The second elongate planar blade body 16 includes a file surface 17 defined by a predetermined abrasive courseness mounted to the planar surfaces of the second planar blade body 16, including an arcuate nose 18 to prevent inadvertent injury during use.

Figure 5:
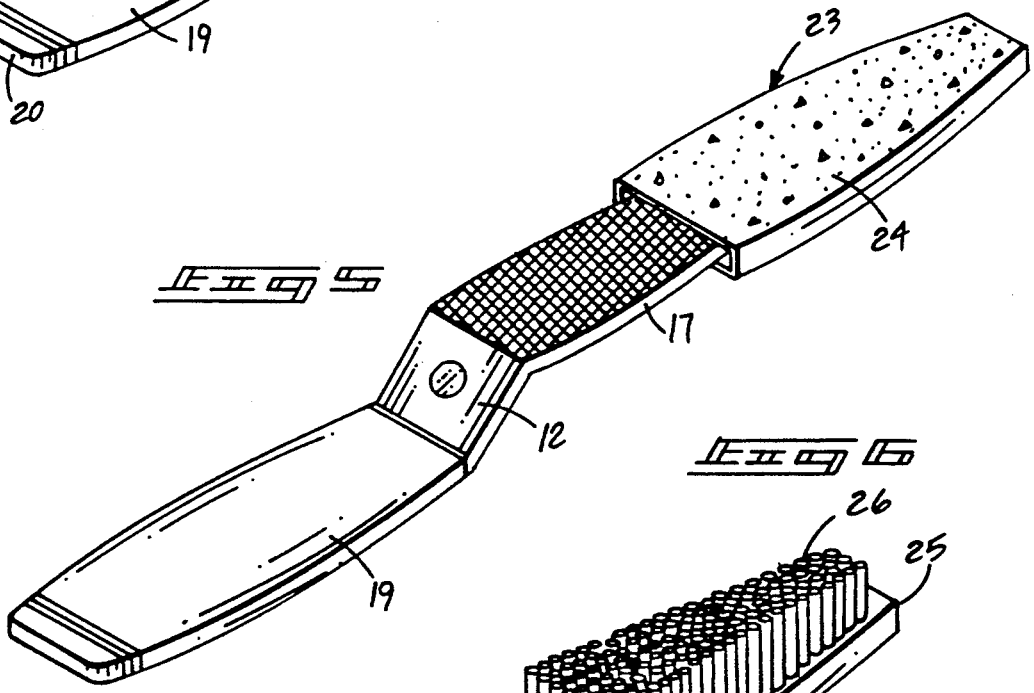
FIG. 5 is an isometric illustration of the manicure file of the instant invention and a third sheath.
Figure 6:
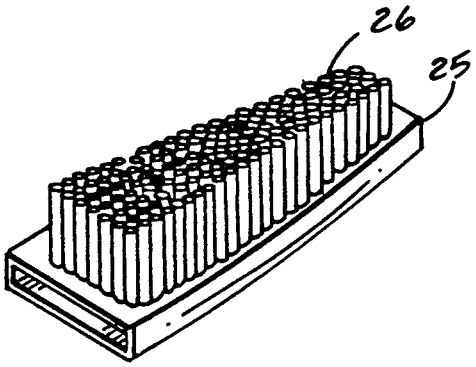
FIG. 6 is an isometric illustration of a fourth sheath utilized by the instant invention.
Figure 7:
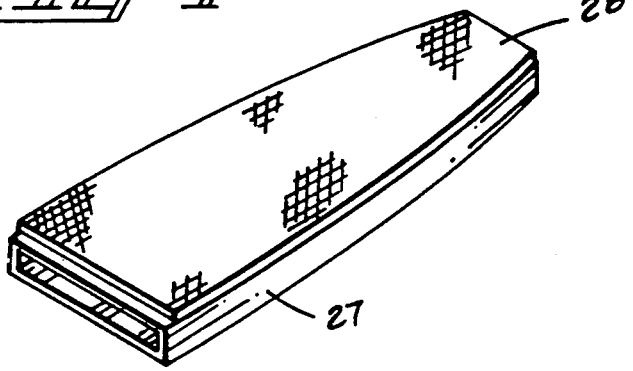
FIG. 7 is an isometric illustration of a fifth sheath utilized by the instant invention.

The first elongate planar blade body 13 includes a first covering sheath 19 defining a cavity complementarily receiving the first elongate planar blade body 13 therewithin. The first sheath 19 includes a blunt cuticle pusher end surface 20 formed to the first sheath to define a surface for the pushing and positioning about a cuticle during a manicuring procedure A second cover sheath 21 (see FIG. 4) includes a second cover abrasive surface 22 defined by a second courseness less than that of the predetermined courseness of the file surface 17, and less than that of a third courseness defined by a third cover sheath abrasive surface 24 of a third cover sheath 23, as illustrated in FIG. 5. In this manner, an individual may by positioning a selective cover sheath 21 or 23 about the first planar blade body 13 effect use of varying courseness surfaces during abrading and manicuring procedures Each of the sheaths 21 and 23 define an internal cavity to complementarily receive the first planar blade body 13 therewithin. Similarly a fourth cover sheath 25 (see FIG. 6) includes a bristle brush matrix 26 orthogonally mounted to a top surface of the fourth cover sheath 25 for complementarily receiving the first blade body 13 within the fourth cover sheath to provide a brushing action, as required during manicuring Similarly, a requisite fifth cover sheath 27 includes a fifth cover sheath polishing cloth laminate 28 mounted to a top surface of the fifth cover sheath 27 to permit buffing of a cuticle, as required.

Figure 8:
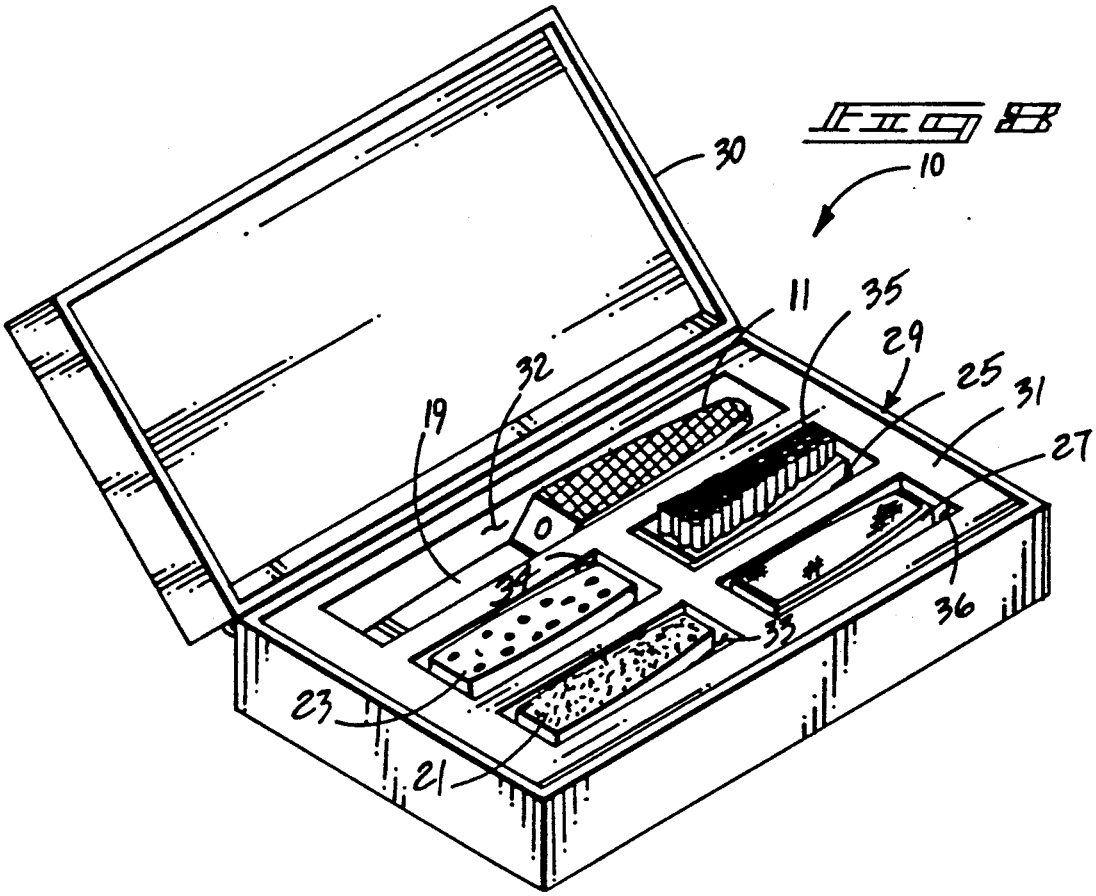
FIG. 8 is an isometric illustration of the kit utilized by the instant invention.

FIG. 8 illustrates the use of a container 29 including a container lid 30 hingedly mounted at a lowermost longitudinal edge of the lid 30 to an upper longitudinal edge of the container 29 to permit enclosing of the contents therewithin. The container 29 includes a container floor 31, with the container floor including a first elongate recess 32 to receive the file body 11 therewithin. A respective second, third, fourth, and fifth elongate recess 33, 34, 35, and 36 respectively each of an equal length is less than that defined by the predetermined length of the first elongate recess 32 to accommodate the second, third, fourth, and fifth cover sheaths 21, 23, 25, and 27 respectively therewithin to set forth a compact and convenient storage and transport organization for use with components of the kit to enable ease of access of the various components during use or storage.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the Unites States is as follows:

1. A manicure file kit comprising, in combination, a container, the container including a container body and a lid, the lid mounted for overlying the container body, and the container body including a floor, with the floor defining a first elongate recess, and an elongate, longitudinally aligned, generally "S" shaped file body mounted within the first elongate recess, the file body including a central holding plate, the holding plate including a forward terminal edge and a rear terminal edge, the forward terminal edge integrally mounting a first planar body at an obtuse angle thereto, with the rear terminal edge of the holding plate mounting a second elongate planar blade body at an obtuse included angle to the holding plate, wherein the first elongate blade body and the second elongate blade bodies are arranged parallel relative one another in a spaced relationship, and wherein the first elongate planar blade body includes a file surface, with the file surface defined by a predetermined courseness, and the first planar blade body including a forward terminal end remote from the holding plate, wherein the forward terminal end defines an arcuate nose, and wherein the second planar blade body includes a second planar blade body free terminal end remote from the holding plate, wherein the free terminal end includes a plurality of spaced fixed rigid blades, the blades defining an acute angle therebetween, and including a first cover sheath, the first cover sheath defining a first cavity complementarily receiving the second blade body therewithin, and the first cover sheath including an end surface, wherein the end surface is planar to define a pushing surface, and including a second cover sheath, the second cover sheath defined by a second cover sheath cavity complementarily receiving the first blade body therewithin, and the second cover sheath including an exterior surface of a second courseness less than that defined by the predetermined courseness of the file surface of the first blade body, and the container floor including a second elongate recess to complementarily receive the second cover sheath therewithin, and including a third cover sheath, the third cover sheath defined by a third cover sheath cavity to complementarily receive the second blade body therewithin, and the third cover sheath including a third cover sheath exterior abrasive surface defined by a third courseness, wherein the third courseness is greater than the second courseness, and the container floor including a third elongate recess to complementarily receive the third cover sheath therewithin, and a fourth cover sheath, the fourth cover sheath including a fourth cover sheath cavity, the fourth cover sheath cavity complementarily receiving the first blade body therewithin, and the fourth cover sheath including a matrix of bristle brush members orthogonally mounted to an exterior surface of the fourth cover sheath, and the container floor including a fourth cover sheath recess to complementarily receive the fourth cover sheath therewithin, and a fifth cover sheath, the fifth cover sheath including a fifth cover sheath cavity to complementarily receive the first blade body therewithin, and the fifth cover sheath including a polishing cloth laminate mounted to an exterior surface of the fifth cover sheath, and the container floor including a fifth elongate recess to complementarily receive the fifth cover sheath therewithin.

* * * * *